US005085309A

United States Patent [19]

Adamson et al.

[11] Patent Number: 5,085,309

[45] Date of Patent: Feb. 4, 1992

[54] ELECTRONIC COIN DETECTOR

[76] Inventors: Phil A. Adamson, 32220 Oakshore Dr., Westlake Village, Calif. 91361; Andrew J. Yeiser, Huntington Beach, Calif.

[21] Appl. No.: 363,260

[22] Filed: Jun. 7, 1989

[51] Int. Cl.[5] ..... G07D 5/04

[52] U.S. Cl. ..... 194/317; 194/339

[58] Field of Search ..... 194/339, 317, 318, 319; 177/211

[56] References Cited

U.S. PATENT DOCUMENTS

| | | | |
|---|---|---|---|
| 3,869,663 | 3/1975 | Tschierse | 324/34 |
| 4,091,908 | 5/1978 | Hayashi et al. . | |
| 4,108,296 | 8/1978 | Hayashi et al. . | |
| 4,124,111 | 11/1978 | Hayashi . | |
| 4,254,857 | 3/1981 | Levasseur et al. . | |
| 4,441,602 | 4/1984 | Ostroski et al. . | |
| 4,460,080 | 7/1984 | Howard . | |
| 4,462,513 | 7/1984 | Dean et al. . | |
| 4,509,633 | 4/1985 | Chow . | |
| 4,522,275 | 6/1985 | Anderson | 177/25.13 |
| 4,660,705 | 4/1987 | Kai et al. | 194/318 |
| 4,664,244 | 5/1987 | Wright | 194/317 |
| 4,667,093 | 5/1987 | MacDonald | 250/223 |
| 4,678,994 | 7/1987 | Davies | 324/236 |
| 4,696,385 | 9/1987 | Davies | 194/319 |
| 4,705,154 | 11/1987 | Masho et al. | 194/319 |
| 4,733,766 | 3/1988 | Roberts et al. | 194/327 X |
| 4,796,212 | 1/1989 | Kitagawa | 177/211 X |
| 4,848,556 | 7/1989 | Shah et al. | 194/212 |

*Primary Examiner*—F. J. Bartuska
*Attorney, Agent, or Firm*—Lyon & Lyon

[57] ABSTRACT

An electronic device with no moving parts identifies and counts coins. The device may comprise a plurality of sensors and appropriate circuitry for interpreting the signals emitted by the sensors. In a preferred embodiment, a sensor to detect the presence of a ferrous object, a sensor to detect the presence of a solid object, and a sensor to measure the weight of a coin are each implemented in an inexpensive and reliable manner by use of electronic components. Sensed information is collected and processed by a programmable microprocessor.

9 Claims, 3 Drawing Sheets

ELECTRONIC COIN DETECTOR

BACKGROUND OF THE INVENTION

1. Field of the Invention

This invention relates to the field of coin detection by electronic devices.

2. Description of Related Art

The object of detecting and identifying coinage is well known and has numerous applications, e.g. in parking meters, subway turnstiles, and vending machines. Coin detectors known to the inventor use mechanical sensors which attempt to detect proffered coinage and to determine if that coinage is legitimate. Mechanical linkages may be employed to transmit the data from mechanical detection and identification of coinage to the coin-accepting device.

While mechanical sensors appear to achieve their purpose, i.e. to detect and identify coinage, they can be subject to a number of drawbacks. First, mechanical sensors may be subject to wear and tear, e.g. they may break down or suffer lack of sensitivity when subjected to physical stresses such as heat, cold, or physical attacks on the devices which carry them. Second, mechanical sensors are inflexible, i.e. it is generally not easy to reprogram them to account for new coinage or new charge rates. Third, mechanical sensors are far more expensive to build and repair than electrical sensors.

Accordingly, it is an object of the invention to provide an improved method for detecting and identifying coinage, and a device which implements that improved method.

SUMMARY OF THE INVENTION

An electronic device with no moving parts identifies and counts coins. The device may comprise a plurality of sensors and appropriate circuitry for interpreting the signals emitted by the sensors. In a preferred embodiment, a sensor to detect the presence of a ferrous object, a sensor to detect the presence of a solid object, and a sensor to measure the weight of a coin are each implemented in an inexpensive and reliable manner by use of electronic components. Sensed information is collected and processed by programmable computing means.

BRIEF DESCRIPTION OF THE DRAWINGS

FIG. 2 is a flow chart of a process followed by a microprocessor in a preferred embodiment of the invention.

DESCRIPTION OF THE PREFERRED EMBODIMENT

Figure 1:
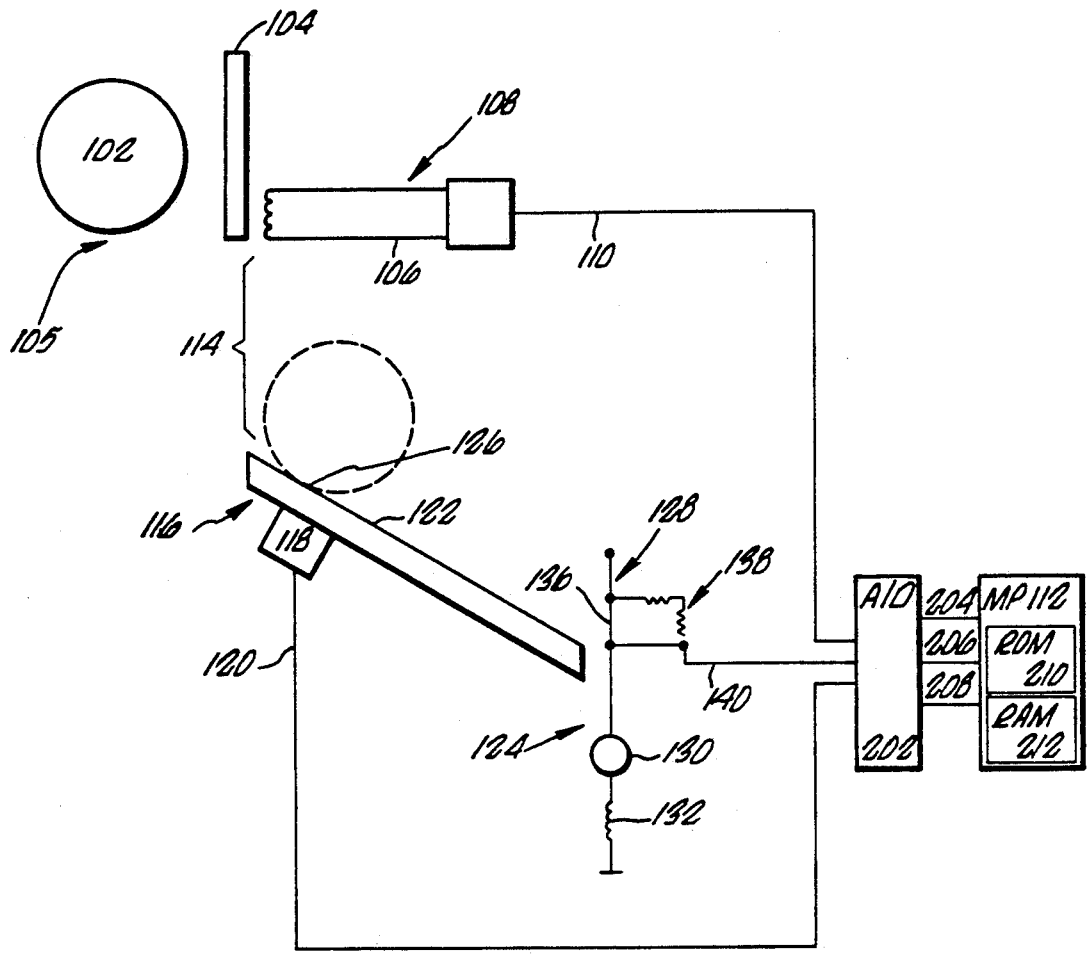
FIG. 1 is a block diagram of a circuit of a preferred embodiment of the invention.

FIG. 1 is a block diagram of a circuit of a preferred embodiment of the invention. A receptacle for receiving a coin 102 comprises a coin slot 104, of a size to easily admit one of a plurality of types of valid coins, but of a shape and size to restrict movement of such coins substantially to a preferred orientation. A preferred orientation has each coin 102 aligned with a major axis perpendicular to the coin slot 104, such that a substantial portion of the weight of the coin 102 is borne by an edge 105 of the coin.

As the coin 102 enters the coin slot 104, it passes through a sensor loop 106 of a ferrous metal detector 108, for detecting the presence of a ferrous object. In a preferred embodiment, the ferrous metal detector 108 is a magnetic sensor having a sensor loop 106 disposed so that an electromagnetic effect is detected when a ferromagnetic object passes through. In one embodiment of the invention, the ferrous metal detector 108 could operate based on the variable reluctance of the sensor loop 106 in conjunction with the coin 102. An electrical signal emitted by the ferrous metal detector 108 on line 110 may be transmitted to and ultimately processed by a microprocessor 112 operating under software control.

After passing through the ferrous metal detector 108, the coin 102 falls a short distance 114 to strike a solid object detector 116. In a preferred embodiment, the solid object detector 116 may comprise a piezoelectric device 118 which is sensitive to pressure and which generates an electrical signal on line 120 in response thereto. This electrical signal on line 120 may be transmitted to and ultimately processed by the microprocessor 112 operating under software control.

After triggering the solid object detector 116, the coin 102 rolls down a guide ramp 122 towards a weight detector 124. In a preferred embodiment, the guide ramp 122 may comprise a shaped surface (shaped to present a substantially elliptical cross section) to guide the coin 102 in its descent, treated to present sufficient friction at the point of contact 126 such that the coin 102 will roll rather than slide.

After rolling down the guide ramp 122 the coin 102 strikes the weight detector 124 with a velocity substantially within predetermined values. In a preferred embodiment, the weight detector 124 may comprise a strain gauge 128, having a weight 130 and a spring 132 for exerting a predetermined strain, and emitting an electrical signal whose voltage is variable and based on strain which the strain gauge 128 undergoes, as is well known in the art. It will be clear to one skilled in the art that the signal emitted by the strain gauge 128 (on line 134) will vary based on differing weights which the coin 102 may have.

In a preferred embodiment, the strain gauge 128 may comprise a wire 136 whose strain is measured. This wire 136 is configured to be one leg of a resistance bridge 138, and the resistance of the wire 136 is measured by measuring a voltage imbalance of the bridge 138 on line 140. This electrical signal on line 140 may be transmitted to and ultimately processed by the microprocessor 112 operating under software control.

The signals on line 110 (an indicator from the ferrous metal detector 108), 120 (an indicator from the solid object detector 116) and 140 (a measurement from the weight detector 124) are transmitted to an A/D converter 202 for conversion to digital values, output on lines 204, 206 and 208 respectively. The A/D converter 202 measures and converts each signal on lines 110, 120 and 140 at frequent intervals; in a preferred embodiment these intervals will be sufficiently frequent that there are at least three measurements of the resistance of the strain gauge 128 during passage of a single coin 102 over the weight detector 124. No zero adjustments are necessary because the bridge 138 is A.C. coupled to the A/D converter 202.

The microprocessor 112 may receive and analyze each signal on lines 202, 206 and 208 to determine if a coin 102 is present, whether the coin 102 is ferrous (and thus likely to be a slug), and the weight of the coin 102. Due to the relatively precise operating capability of the weight detector 124, the microprocessor 112 may determine the weight of the coin 102 within relatively precise tolerances. The microprocessor 112 may then use this information to determine the identity of the coin 102, including whether or not the coin 102 is legal tender, as described below.

In a preferred embodiment, the microprocessor 112 operate under software control in conjunction with ROM 210 and RAM 212. Software to control the microprocessor 112 may be stored in ROM 210 and accessed by the microprocessor 112 during ordinary operation; calculated values may be stored in RAM 212 and accessed by the microprocessor 112 during ordinary operation, as is well known in the art. It would be clear to those of ordinary skill in the art, after perusal of the specification, drawings and claims herein, that modification of a standard microprocessor system to perform the control functions disclosed herein would be a straightforward task and would not require undue experimentation.

The values output by the A/D converter 202 on lines 204, 206 and 208 are transmitted to and stored in RAM 210 in a digital representation suitable for processing by the microprocessor 112. The signal on line 110, from the ferrous metal detector 108, is digitized by the A/D converter 202 and converted to a binary digital signal on line 204. Similarly, the signal on line 120, from the solid object detector 116, is digitized by the A/D converter 202 and converted to a binary digital signal on line 206.

The microprocessor 112 may access the values output by the A/D converter 202 on lines 204, 206 and 208. The voltage measurements from the bridge 138, on line 208 may be processed by the microprocessor 112 by a curve-fitting technique, or by a polynomial-fit technique. Both of these techniques are standard numerical analysis techniques, well known in the art, for determining a best-fit curve through a number of data points. A best-fit curve is determined for the voltage measurements on line 208. This allows the mass of the coin to also be determined, because the peak of the curve is a measure of the mass of the coin. Similarly, this allows the diameter of the coin to also be determined, because the area under the curve divided by the peak of the curve is a measure of the diameter of the coin. (A larger coin would remain on the strain gauge 128 longer and would thus produce a signal of longer duration.)

Similarly, the microprocessor processes the signal on line 204, from the ferrous metal detector 108, to determine whether a ferrous coin is being tested, and the signal on line 206, from the solid object detector 116, to determine whether a solid object is being detected. The microprocessor 112 can also accept inputs from other sensors (not shown) which could be added to the system if other data are deemed to be of value in distinguishing false or counterfeit coins.

Figure 2A:
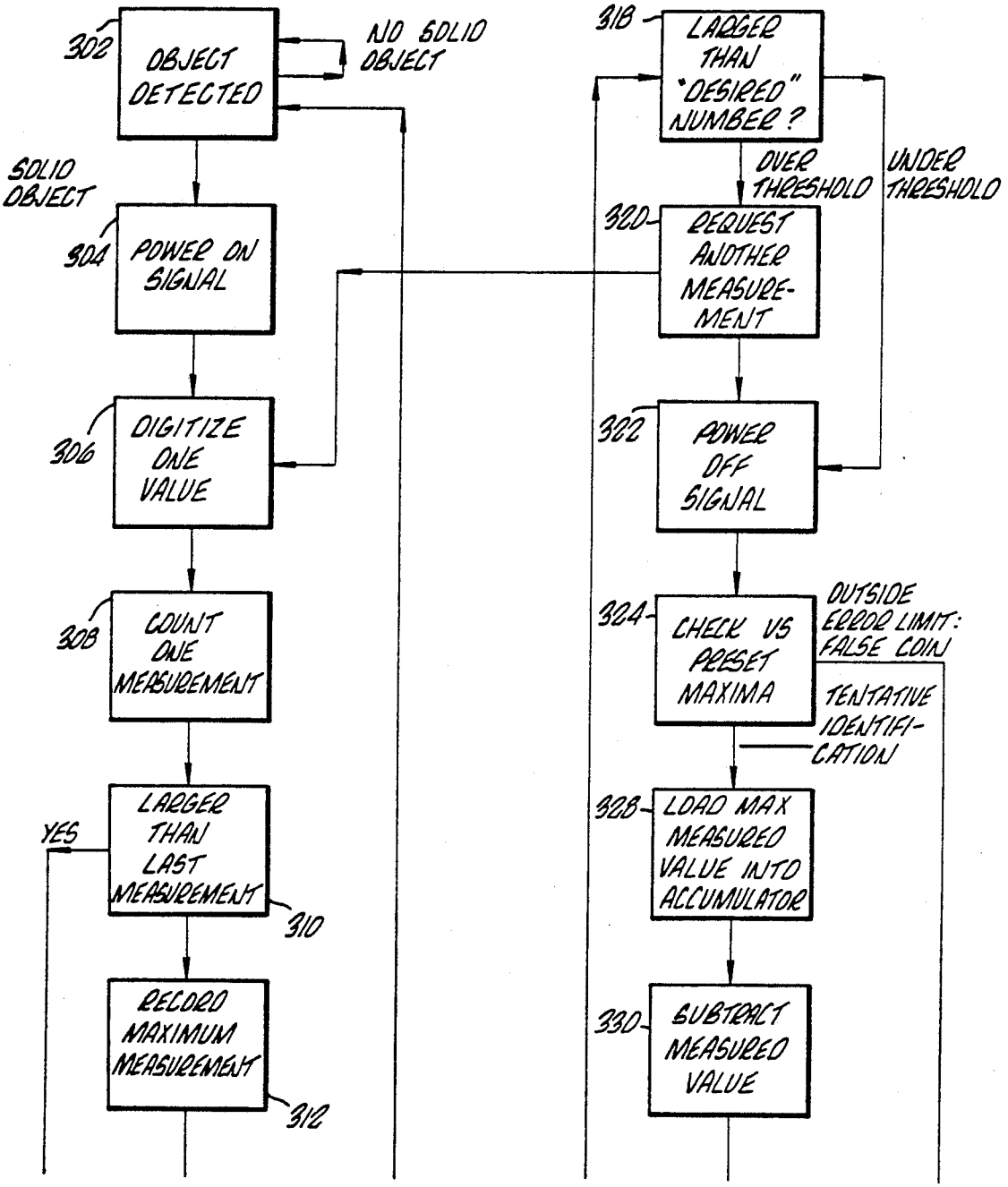
FIGS. 2A-2B are combined into a single drawing; these figures are collectively referred to herein as 'FIG. 2'.
Figure 2B:
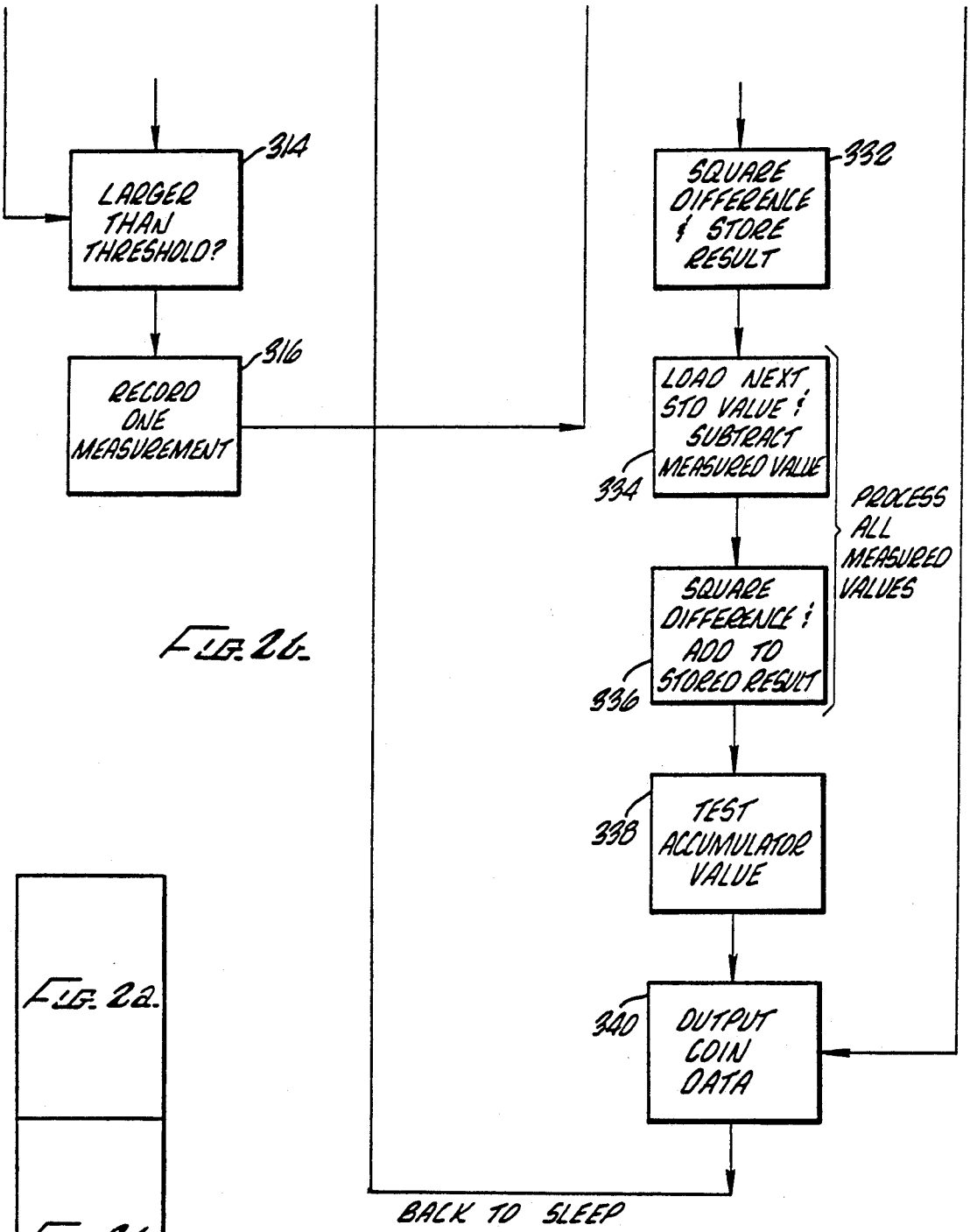
Figure 2:
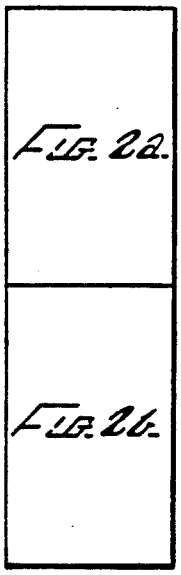
FIG. 2 shows how

FIG. 2 is a flow chart of process followed by a microprocessor 112 in a preferred embodiment of the invention. In a preferred embodiment the microprocessor 112 may comprise an Intel 80C51 microprocessor with associated ROM and RAM memory circuits, configured as is well known in the art. As is well known in the art, the steps disclosed herein may be implemented with standard programming techniques, and it would be clear to one of ordinary skill in the art, after perusal of the specification, drawings and claims herein, that modification of a standard microprocessor system to incorporate such software would not require any undue experimentation.

At step 302, an "object-detected" signal from the solid object detector 116 is input to the microprocessor 112. If the object-detected signal indicated that a solid object has been detected, the microprocessor 112 is taken out of a "sleep" mode and the process continues with step 304. Else, the microprocessor 112 remains in sleep mode at step 302.

At step 304, the microprocessor 112 sends a "power-on" signal, to turn on battery power to the resistance bridge 138 of the strain gauge 128, and to turn on battery power to the A/D converter 202.

At step 306, the A/D converter 202 makes a measurement and places the digitized value in RAM 212.

At step 308, the microprocessor 112 adds one to a "measurement" counter, to count the number of measurements.

At step 310, the microprocessor 112 checks the measurement to see if it is larger or smaller than the previous measurement. If smaller, the process continues with step 312. Else, the process continues with step 314.

At step 312, the microprocessor 112 records in RAM 212 the location where the previous measurement (i.e. the maximum measurement) will be stored in RAM 212, and the process continues at step 314.

At step 314, the microprocessor 112 checks the measurement to see if it is larger or smaller than a "threshold" value. This test determines whether the measurement process should be continued or discontinued. If the measurement is below the threshold, a "stop flag" is set.

At step 316, the microprocessor 112 records the current measurement in RAM 212, at the memory location preset for the current value of the measurement counter, and the process continues at step 318.

At step 318, the microprocessor 112 checks the measurement counter to see if it is larger or smaller than a "desired" number of measurements. The desired number is selected to perform more measurements than would be required for the largest diameter coin to be identified. A larger number causes step 320 to be performed.

Step 320 is performed only if the check in step 314 gave a "larger" result. Else, the process continues with step 322. At step 322, if the check in step 318 gave a "smaller" result, a first timer is started, with a 100 microsecond timeout. After a timeout, the microprocessor 112 sends a signal to the A/D converter 202 asking for another measurement, and the process continues with step 306.

At step 322 (the check in step 314 gave a "smaller" result), the microprocessor 112 tests for the presence of the stop flag. If the stop flag is set, the microprocessor 112 sends a "power-off" signal, to turn off battery power to the resistance bridge 138 of the strain gauge 128, and to turn off battery power to the A/D converter 202. The microprocessor 112 also turns off the stop flag.

At steps 324 through 322, the microprocessor 112 performs a well known curve-fitting technique or polynomial-fit technique to find the actual weight and size of the coin 102.

At step 324, the microprocessor 112 checks the maximum measurement against preset standard maxima for the known coin denominations which it is desired to identify. If, for a known coin denomination, the maximum measurement is closer to the standard maximum than a preset standard error value, the microprocessor 112 tentatively identifies the coin 102 as being that denomination, and the process continues with step 328 to verify that selection.

At steps 328 through 322, the microprocessor 112 calculates a least-squares difference of the series of measurements which was received from the preset standard measurements for the tentatively identified coin denomination.

At step 328, the microprocessor 112 loads the present standard maximum measurement for the tentatively identified coin denomination into an accumulator register in RAM 212.

At step 330, the microprocessor 112 subtracts the measured value from the value in the accumulator register.

At step 332, the difference is squared and the result placed into a storage register in RAM 212.

At step 334, the next largest standard measurement is placed in the accumulator register in RAM 212. The microprocessor 112 subtracts the measured value from the next largest standard value.

At step 336, the microprocessor 112 squares the difference and adds the result to the value stored in RAM 212 in step 332. If there are additional measured values, this process is continued by repeating steps 334 and 336 until all measured values have been processed.

At step 338, if the value computed in step 336 is zero or less than some preset standard variance value, the microprocessor 112 identifies the coin 102 as being the denomination tentatively selected in step 324. If the result is greater than the preset value, the coin is identified as illegitimate since it is not within the specified weight and diameter tolerances.

At step 340, the microprocessor 112 outputs data from ROM 210 relating to the known coin denomination which the microprocessor 11 has determined the coin 102 to be. The microprocessor 112 returns to sleep mode and the process continues with step 302.

While a preferred embodiment is disclosed herein, many variations are possible which remain within the scope and concept of the invention, and these variations would become clear to one skilled in the art after a perusal of the specification, drawings and claims herein.

I claim:

1. An electronic device for detecting the presence of a coin which may be one of a number of predetermined denominations, comprising means for generating a sequence of signals, each responsive to an instantaneous weight measurement of a moving coin; and means for interpreting said sequence of signals and for determining a weight and diameter of said coin.

2. An electronic device as in claim 1, wherein said means for generating comprises strain gauge means for generating a resistance value responsive to an instantaneous weight measurement of a moving coin;

bridge means responsive to said resistance value for generating a voltage signal responsive to said instantaneous weight measurement; and A/D converter means responsive to said voltage signal for generating a digital signal response to said instantaneous weight measurement.

3. An electronic device as in claim 1, wherein said means for interpreting comprises a microprocessor operating under software control.

4. An electronic device as in claim 3, wherein said software comprises means for directing said microprocessor to perform a computation which is one of the group composed of curve-fitting techniques and polynomial-fit techniques.

5. A method for detecting the presence of a coin which may be of any number of selected denominations, comprising the steps of generating a sequence of signals, each responsive to an instantaneous measurement of a force applied by a moving coin; and interpreting said sequence of signals to determine a weight and diameter of said coin.

6. A method as in claim 5, wherein said step of generating comprises the steps of generating a resistance value responsive to an instantaneous weight measurement of a coin;

converting said resistance value into a voltage signal responsive to said instantaneous weight measurement; and converting said voltage signal into a digital signal response to said instantaneous weight measurement.

7. A method as in claim 5, wherein said step of interpreting comprises the step of directing a microprocessor to perform a computation which is one of the group composed of curve-fitting techniques and polynomial-fit techniques.

8. An electronic device for detecting the presence of a coin which may be one of a number of predetermined denominations, comprising means for generating a sequence of signals, each responsive to an instantaneous weight measurement of a moving coin; and means for interpreting said sequence of signals and for determining a weight and diameter of said coin;

wherein said means for interpreting comprises means for ascertaining a maximum value and an integral of a function approximating said sequence of signals.

9. A method for detecting the presence of a coin which may be of any number of selected denominations, comprising the steps of generating a sequence of signals, each responsive to an instantaneous measurement of a force applied by a moving coin; and interpreting said sequence of signals to determine a weight and diameter of said coin;

wherein said step of interpreting comprises the step of ascertaining a maximum value and an integral of a function approximating said sequence of signals.

* * * * *